US007559794B2

(12) United States Patent
Taguchi et al.

(10) Patent No.: US 7,559,794 B2
(45) Date of Patent: Jul. 14, 2009

(54) SOLENOID CONNECTOR

(75) Inventors: Yukihiko Taguchi, Maebashi (JP); Yoshihiro Ochiai, Tomioka (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 246 days.

(21) Appl. No.: 11/573,315

(22) PCT Filed: Aug. 3, 2005

(86) PCT No.: PCT/JP2005/014169

§ 371 (c)(1),
(2), (4) Date: Feb. 6, 2007

(87) PCT Pub. No.: WO2006/013872

PCT Pub. Date: Feb. 9, 2006

(65) Prior Publication Data

US 2007/0184697 A1 Aug. 9, 2007

(30) Foreign Application Priority Data

Aug. 6, 2004 (JP) ..... 2004-231327

(51) Int. Cl.
*H01R 13/60* (2006.01)

(52) U.S. Cl. ..... 439/533; 439/127; 439/349

(58) Field of Classification Search ..... 439/559, 439/271–273, 349, 127, 553; 310/71
See application file for complete search history.

(56) References Cited

U.S. PATENT DOCUMENTS 3,997,232 A * 12/1976 Dunaway ..... 310/68 R
4,204,739 A * 5/1980 Shoenleben ..... 439/263
4,239,319 A * 12/1980 Gladd et al. ..... 439/620.21
4,295,701 A * 10/1981 Gunn ..... 439/271
5,113,101 A * 5/1992 Liu et al. ..... 310/87
5,518,419 A * 5/1996 Denyer et al. ..... 439/559
5,567,170 A * 10/1996 Kroeber ..... 439/186
5,801,465 A * 9/1998 Yamada ..... 310/71
6,290,537 B1 * 9/2001 Sommer ..... 439/559
6,591,684 B2 * 7/2003 Babala et al ..... 73/715

FOREIGN PATENT DOCUMENTS

JP H07-326424 A 12/1995
JP 11-159449 * 6/1999
JP 2001-227457 A 8/2001
JP 2003-124021 A 4/2003

* cited by examiner

*Primary Examiner*—Neil Abrams
(74) *Attorney, Agent, or Firm*—Baker Botts L.L.P.

(57) ABSTRACT

A connector is provided to be connected to a solenoid embedded in a hole formed on a housing of a device to be attached. The connector is provided with connector electric terminal members which can be engaged with electric terminal members of the solenoid, and a case which stores the connector electric terminal members, is removably attached to the solenoid and covers an opening edge part of the hole. The structure of the connector requires lower process cost for ensuring waterproof and corrosion resistance of the solenoid, compared with a conventional structure. Optionally, a seal between the case and opening edge part of the hole and a diode between the connector electric terminal members and electric terminal members of the solenoid is provided.

9 Claims, 4 Drawing Sheets

SOLENOID CONNECTOR

TECHNICAL FIELD OF THE INVENTION

The present invention relates to a connector connected to a solenoid embedded in a hole formed on a housing of a device to be attached.

BACKGROUND OF THE INVENTION

A connector connected to a solenoid embedded in a hole formed on a housing of a device to be attached is disclosed, for example, in Pat. Application publication No. JP-H11-159449 A.

Since this connector of Patent Application Publication No.JP-H11-159449 A is attached to a solenoid housing one end of which is exposed to the atmosphere from an opening edge part of the above-described hole, in order to ensure the waterproof and corrosion resistance of a solenoid, it is considered that it is necessary to carry out a surface treatment for corrosion resistance on the outer surface of the solenoid housing, and it causes increase of cost for manufacturing the solenoid.

DISCLOSURE OF THE INVENTION

Problems to be Solved by the Invention

Accordingly, an object of the present invention is to provide a connector connected to a solenoid embedded in a hole formed on a housing of a device to be attached, which can reduce the process cost for ensuring waterproof and corrosion resistance of the solenoid, compared with a conventional structure.

Means for Solving the Problems

To achieve the above objects, a connector according to the present invention is connected to a solenoid embedded in a hole formed on a housing of a device to be attached, and the connector comprises connector electric terminal members capable of being engaged with electric terminal members of the solenoid, and a case which stores the connector electric terminal members, which is removably attached to the solenoid and which covers an opening edge part of the hole.

In this connector according to the present invention, because the case of the connector covers the opening edge part of the hole in which the solenoid is embedded, the solenoid is not exposed directly to the outside environment, and there is few chance of contact with moisture. Therefore, even if the grade of the treatment for ensuring the waterproof and corrosion resistance is reduced as compared with a conventional grade, the waterproof and corrosion resistance of the solenoid can be ensured. Therefore, in the connector according to the present invention, the process cost for ensuring the waterproof and corrosion resistance of the solenoid can be reduced, compared with a conventional structure.

In the connector according to the present invention, it is preferred that a seal member is provided for sealing a gap between the case and the opening edge part of the hole. By the structure where the seal member is disposed for sealing a gap between the case of the connector and the opening edge part of the hole in which the solenoid is embedded, the solenoid is completely isolated from outside environment, and contact chance with moisture is wiped out. As a result, the process cost for ensuring the waterproof and corrosion resistance of the solenoid can be further reduced.

Further, in the connector according to the present invention, it is preferred that the case is molded with a resin. By molding the case of the connector with a resin, it is facilitated to make the shape of the case complicated, the electric insulation property of the connector may be improved, and the connector may be made light.

Further, in the connector according to the present invention, it is preferred that a rotation preventing mechanism is formed at an engaging portion between the case and the solenoid. By preventing rotation of the connector relative to the solenoid, it is prevented that an excessive force is applied to electric terminal members of both the connector and the solenoid and the electric terminal members are damaged.

Further, in the connector according to the present invention, it is preferred that a removal preventing mechanism is formed at an engaging portion between the case and the solenoid. By this, removal of the connector from the solenoid may be prevented.

Further, in the connector according to the present invention, it is preferred that a rotation preventing mechanism for preventing rotation of the case relative to the housing of the device to be attached is formed at an engaging portion between the case and the housing of the device to be attached. By this, it is prevented that the connector rotates by receiving an external force and electric terminal members are damaged.

Further, in the connector according to the present invention, it is preferred that a removal preventing member engaged with the hole of the housing of the device to be attached is provided for engaging the case and preventing removal of the case from the hole. By this, removal of the connector from the housing of the device to be attached may be prevented, and ultimately, removal of the solenoid from the housing of the device to be attached may be prevented.

Further, in the connector according to the present invention, it is preferred that a diode is disposed between the connector electric terminal members. By disposing a diode in the connector, the structure of the solenoid may be simplified.

Such a connector according to the present invention is suitable in a case where the device to be attached is a variable displacement compressor, and in particular, suitable in a case where the variable displacement compressor is a compressor used in an air conditioning system for a vehicle.

Effect According to the Invention

In the connector according to the present invention, because the case of the connector covers the opening edge part of the hole in which the solenoid is embedded, the solenoid is not exposed directly to the outside environment, and there is few chance of contact with moisture. Therefore, even if the grade of the treatment for ensuring the waterproof and corrosion resistance is reduced as compared with a conventional grade, the waterproof and corrosion resistance of the solenoid can be ensured. Therefore, in the connector according to the present invention, the process cost for ensuring the waterproof and corrosion resistance of the solenoid can be reduced, compared with a conventional structure.

BRIEF EXPLANATION OF THE DRAWINGS

FIG. 1 shows a structure of a solenoid valve provided with a connector according to an embodiment of the present invention, In FIGS. 1B and 1D, a part of members are perspectively depicted and electric terminal members are shown at an exposed condition.

FIG. 4 shows a structure of a solenoid valve provided with a connector according to a further embodiment of the present invention.

EXPLANATION OF SYMBOLS

Figure 1A:
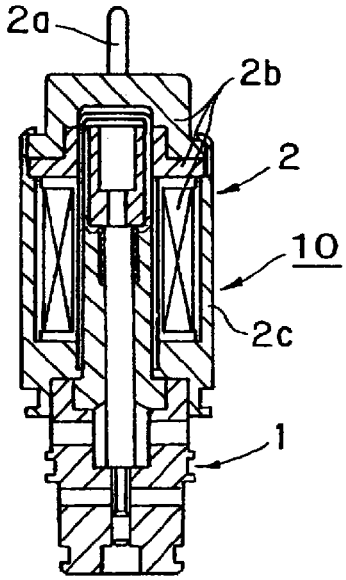
FIG. 1A is a vertical sectional view of a valve part and a solenoid.
Figure 1C:
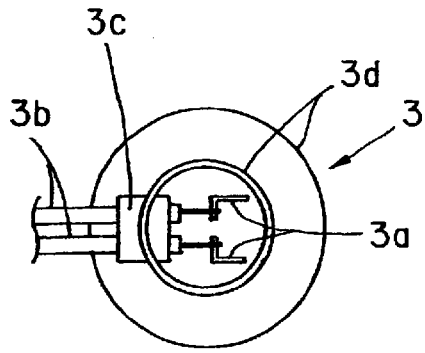
FIG. 1C is a cross-sectional view along line C-C of FIG. 1B.
Figure 1D:
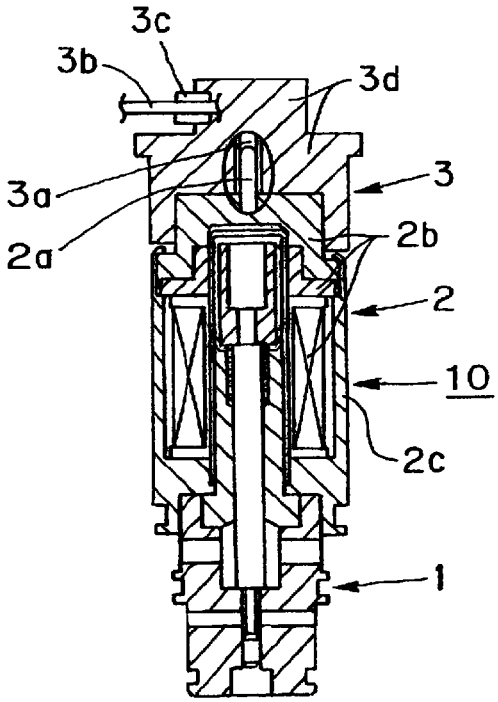
FIG. 1D is a vertical sectional view at a state where the valve part, the solenoid and the connector are integrally assembled.
Figure 1B:
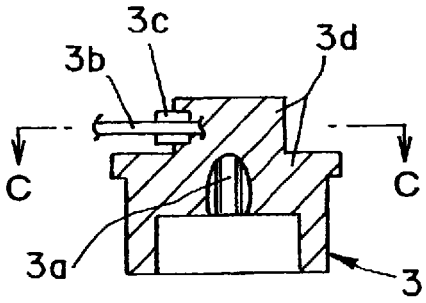
FIG. 1B is a vertical sectional view of the connector.

1: valve part
2: solenoid
2*a*: electric terminal member of solenoid
2*b*: solenoid body
2*c*: solenoid housing
2*d*: groove for engagement
2*e*: stepped portion for engagement
3: connector
3*a*: connector electric terminal member
3*b*: lead wire
3*c*: insulation rubber
3*d*: case
3*e*, 3*f*: projection for engagement
3*g*: claw for engagement
3*h*: terminal member
4: snap ring
5: O-ring
6, 7: rotation preventing mechanism
8: removal preventing mechanism
9: diode
10: solenoid valve
100: housing of variable displacement compressor
101: hole
101*a*: groove for engagement

THE BEST MODE FOR CARRYING OUT THE INVENTION

Hereinafter, desirable embodiments of connectors according to the present invention will be explained as to a case of a connector capable of being applied to a displacement control solenoid valve of a variable displacement compressor, particularly, of a variable displacement compressor suitable for use in an air conditioning system for a vehicle.

FIG. 1 shows a solenoid valve provided with a connector according to an embodiment of the present invention. In FIG. 1, a displacement control solenoid valve 10 of a variable displacement compressor has a valve part 1, a solenoid 2 for driving a valve, and a connector 3 which is removably attached to solenoid 2. Solenoid 2 has a solenoid body 2*b* including a pair of electric terminal members 2*a*, and a solenoid housing 2*c*.

Connector 3 is constructed from a pair of connector electric terminal members 3*a* which can be attached to and detached from the pair of electric terminal members 2*a* of solenoid 2, a pair of lead wires 3*b* coupled to connector electric terminal members 3*a*, an insulation rubber 3*c*, and a case 3*d* made of a resin which stores connector electric terminal members 3*a*.

Connector electric terminal members 3*a* are insert molded integrally with case 3*d*. Insulation rubber 3*c* attached to lead wires 3*b* and closing the peripheries of lead wires 3*b* is engaged to an end portion of case 3*d*, lead wires 3*b* and connector electric terminal members 3*a* are coupled, a resin is injected into case 3*d* surrounding the coupling portion and a lid is provided thereon, and connector 3 is thus formed.

Figure 2:
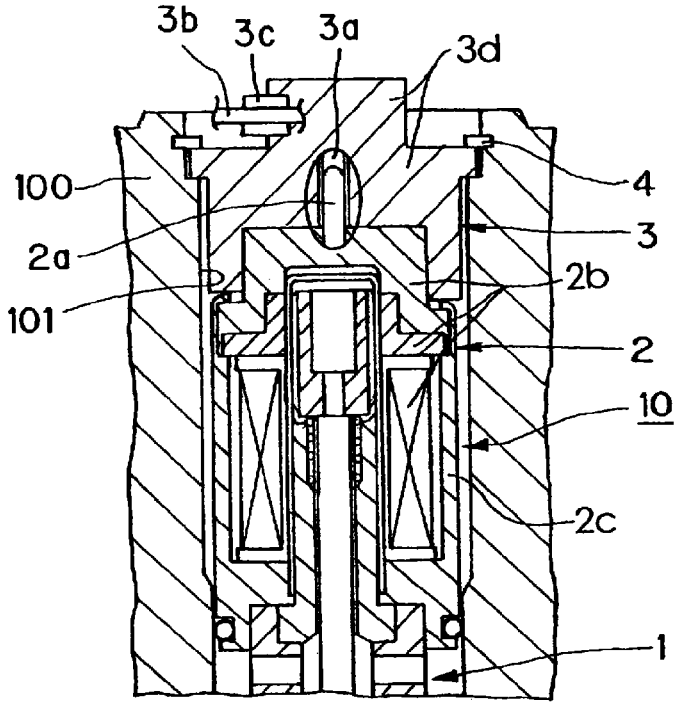
FIG. 2 is a partial, vertical sectional view of a solenoid valve provided with a connector according to an embodiment of the present invention, at a state being attached to a housing of a variable displacement compressor. A part of members are perspectively depicted and electric terminal members are shown at an exposed condition.

As depicted in FIG. 2, solenoid valve 10 is attached to a housing 100 of the variable displacement compressor at a state where valve part 1 and solenoid 2 are embedded in a hole 101 formed on housing 100 of the variable displacement compressor, case 3*d* of connector 3 is removable attached to solenoid body 2*b*, connector electric terminal members 3*a* are engaged with electric terminal members 2*a*, case 3*d* of connector 3 covers the opening edge part of hole 101, and a snap ring 4 engaged with a circumferential groove formed on the opening edge part of hole 101 is engaged with the end surface of case 3*d* of connector 3.

In connector 3 according to this embodiment, because case 3*d* covers the opening edge part of hole 101 in which solenoid 2 is embedded, solenoid 2 is not exposed directly to outside environment, and there is few chance of contact with moisture. Therefore, even if the grade of the treatment for ensuring the waterproof and corrosion resistance is reduced as compared with a conventional grade, the waterproof and corrosion resistance of solenoid 2 can be ensured. Therefore, in connector 3, the process cost for ensuring the waterproof and corrosion resistance of solenoid 2 can be reduced, compared with a conventional structure.

Moreover, by molding case 3*d* of connector 3 with a resin, it is facilitated to make the shape of case 3*d* complicated, the electric insulation property of connector 3 may be improved, and connector 3 may be made light.

Further, by providing snap ring 4, removal of connector 3 from housing 100 may be prevented, and removal of solenoid 2, ultimately, solenoid valve 10, from housing 100 may be prevented.

Figure 3:
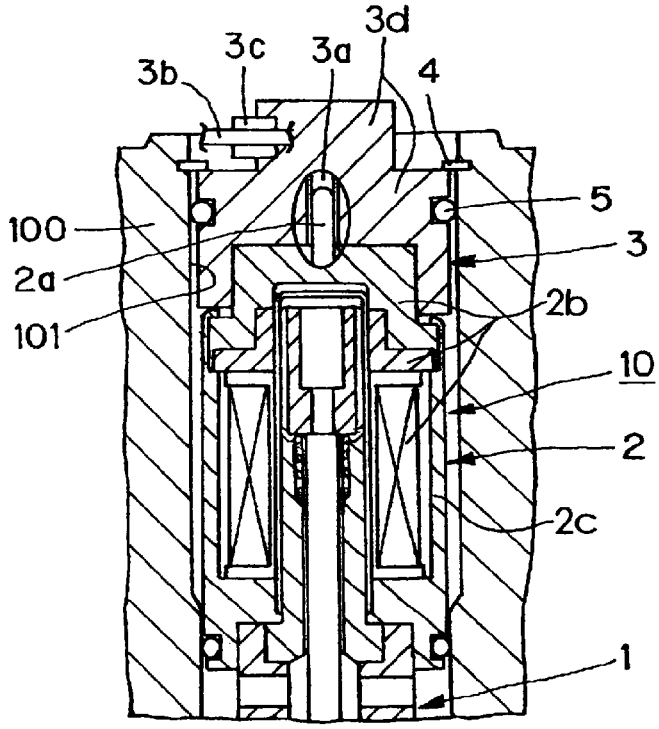
FIG. 3 is a partial, vertical sectional view of a solenoid valve provided with a connector according to another embodiment of the present invention, at a state being attached to a housing of a variable displacement compressor. A part of members are perspectively depicted and electric terminal members are shown at an exposed condition.

FIG. 3 depicts a solenoid valve according to another embodiment. In this embodiment, as depicted in FIG. 3, a gap between the opening edge part of hole 101 and case 3*d* is sealed by an O-ring 5 provided as a seal member stored in a circumferential groove which is formed on the periphery of case 3*d*. In this structure, solenoid 2 is completely isolated from outside environment, contact chance with moisture is wiped out, and therefore, the process cost for ensuring the waterproof and corrosion resistance of solenoid 2 can be further reduced.

Figure 4A:
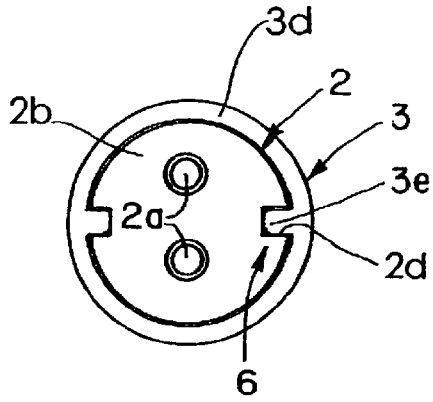
FIG. 4A is a cross-sectional view of an engaging portion between the connector and a solenoid.

FIG. 4 depicts a solenoid valve according to a further embodiment. In this embodiment, as depicted in FIG. 4A, a rotation preventing mechanism 6 comprising a groove for engagement 2*d* formed on solenoid body 2*b* and a projection for engagement 3*e* formed on case 3*d* engaging with groove for engagement 2*d* is formed at an engaging portion between case 3*d* of connector 3 and solenoid body 2*b*. By preventing rotation of connector 3 relative to solenoid 2, it is prevented that an excessive force is applied to electric terminal members 2*a* and 3*a* of both connector 3 and solenoid 2 and electric terminal members 2*a* and 3*a* are damaged.

Figure 4B:
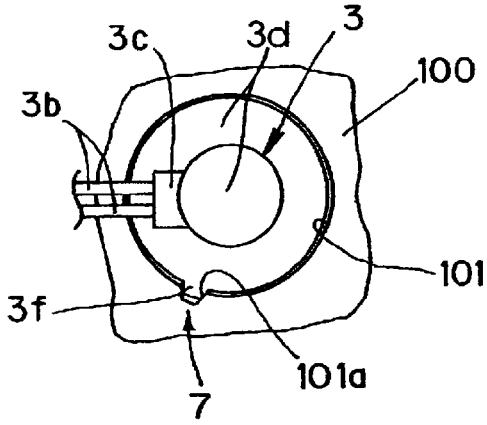
FIG. 4B is a plan view of an engaging portion between the connector and a compressor housing.

Further, as depicted in FIG. 4B, a rotation preventing mechanism 7 comprising a groove for engagement 101*a* formed on the circumferential wall of hole 101 and a projection for engagement 3*f* formed on the periphery of case 3*d* engaging with groove for engagement 101*a* may be formed at an engaging portion between case 3*d* of connector 3 and hole 101. It is prevented that connector 3 rotates by receiving an external force and lead wires 3*b* are damaged.

Figure 5:
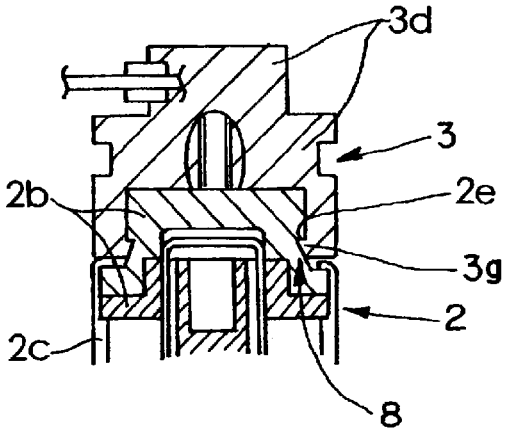
FIG. 5 is a vertical sectional view of an engaging portion between a connector and a solenoid in a solenoid valve provided with the connector according to a further embodiment of the present invention. A part of members are perspectively depicted and electric terminal members are shown at an exposed condition.

FIG. 5 depicts a solenoid valve according to a further embodiment. In this embodiment, as depicted in FIG. 5, a removal preventing mechanism 8 comprising a claw for engagement 3*g* formed on case 3*d* and a stepped portion for engagement 2*e* formed on solenoid body 2*b* with which claw for engagement 3*g* is engaged is formed at an engaging portion between case 3*d* of connector 3 and solenoid body 2*b*. By forming this removal preventing mechanism 8, removal of connector 3 from solenoid 2 may be prevented.

Figure 6:
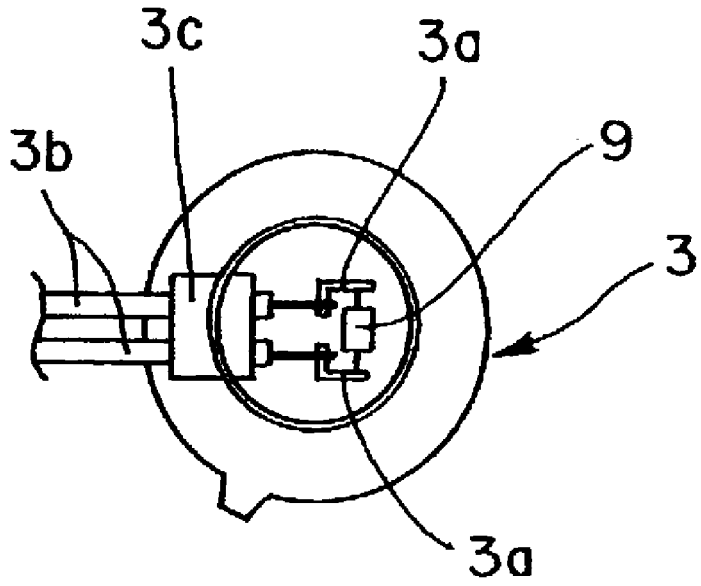
FIG. 6 is a cross-sectional view of a portion corresponding to the portion depicted in FIG. 1C in a connector according to a further embodiment of the present invention.

FIG. 6 depicts a solenoid valve according to a still further embodiment. In this embodiment, as depicted in FIG. 6, a diode 9 for absorbing surging is disposed between the pair of connector electric terminal members 3*a* of connector 3. By providing diode 9 not to solenoid 2 but to connector 3, the structure of solenoid 2 may be simplified, and the productivity of solenoid valve 10 may be improved.

Figure 7:
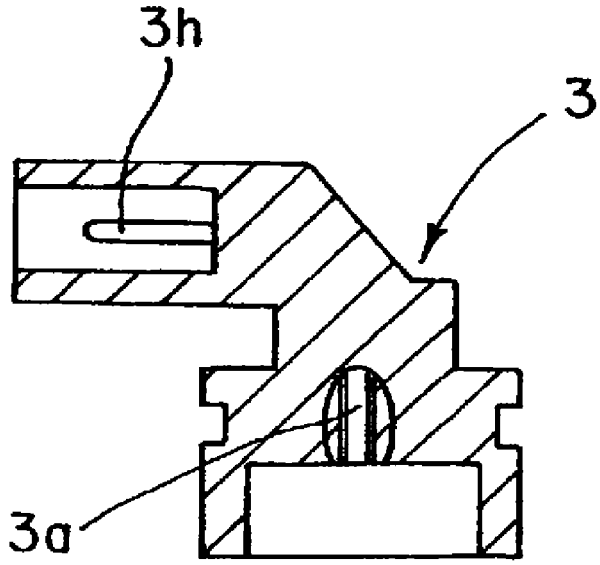
FIG. 7 is a vertical sectional view of a connector according to a further embodiment of the present invention.

FIG. 7 depicts a connector according to a further embodiment. In this embodiment, as depicted in FIG. 7, instead of lead wires 3*b*, terminal members 3*h* are disposed in connector 3.

Further, although not depicted, an appropriate engaging portion for removing connector 3 attached to housing 100 by using a jig may be formed on case 3*d* of connector 3.

INDUSTRIAL APPLICATIONS OF THE INVENTION

The connector according to the present invention can be suitably used not only for a solenoid valve for displacement control of a variable displacement compressor but also for various solenoids attached to housings of devices.

The invention claimed is:

1. A connector connected to a solenoid embedded in a hole formed on a housing of a device to be attached, said connector comprising:

connector electric terminal members capable of being engaged with electric terminal members of said solenoid; and a case which stores said connector electric terminal members, which is removably attached to said solenoid and which covers an opening edge part of said hole, wherein a removal preventing member engaged with said hole of said housing of said device to be attached is provided for engaging said case and preventing removal of said case from said hole.

2. The connector according to claim 1, wherein a seal member is provided for sealing a gap between said case and said opening edge part of said hole.

3. The connector according to claim 1, wherein said case is molded with a resin.

4. The connector according to claim 1, wherein a rotation preventing mechanism is formed at an engaging portion between said case and said solenoid.

5. The connector according to claim 1, wherein a removal preventing mechanism is formed at an engaging portion between said case and said solenoid.

6. The connector according to claim 1, wherein a rotation preventing mechanism for preventing rotation of said case relative to said housing of said device to be attached is formed at an engaging portion between said case and said housing of said device to be attached.

7. The connector according to claim 1, wherein a diode is disposed between said connector electric terminal members.

8. The connector according to claim 1, wherein said device to be attached is a variable displacement compressor.

9. The connector according to claim 8, wherein said variable displacement compressor is a compressor used in an air conditioning system for a vehicle.

* * * * *